United States Patent [19]

Paolini

[11] Patent Number: 4,737,053

[45] Date of Patent: Apr. 12, 1988

[54] AUTOMATIC MACHINE FOR SHAPING THE EXTERNAL PROFILE OF SPECTACLE LENSES

[76] Inventor: Ivano Paolini, Via Carpi, 26, 47037 Rimini, Italy

[21] Appl. No.: 924,939

[22] Filed: Oct. 30, 1986

[30] Foreign Application Priority Data

Nov. 5, 1985 [IT] Italy ..... 3591 A/85

[51] Int. Cl.[4] ..... B24B 7/00

[52] U.S. Cl. ..... 409/104; 51/101 LG; 409/111; 409/112; 409/122

[58] Field of Search ..... 409/95, 103–106, 409/111, 112, 122; 51/101 LG

[56] References Cited

U.S. PATENT DOCUMENTS

| | | | |
|---|---|---|---|
| 3,894,361 | 7/1975 | Georgiadis et al. | 51/101 LG |
| 4,176,498 | 12/1979 | Vulich et al. | 51/101 LG |
| 4,383,393 | 5/1983 | Takubo | 51/101 LG |
| 4,512,108 | 4/1985 | Kobayashi | 51/101 LG |

FOREIGN PATENT DOCUMENTS

| | | | |
|---|---|---|---|
| 2831482 | 2/1979 | Fed. Rep. of Germany | 51/101 LG |
| 2481635 | 11/1981 | France | 51/101 LG |

*Primary Examiner*—John McQuade

*Attorney, Agent, or Firm*—Balogh, Osann, Kramer, Dvorak, Genova & Traub

[57] ABSTRACT

The invention relates to an automatic machine for shaping spectacle lenses, especially those in shatterproof material, with a bevel that serves to hold the lens in the frame. Lenses are copied from a pattern by three cutters which correspond to the three types of conventional bevel in current use; a positioning device stations the lens opposite the cutter giving the requisite bevel. Further devices adjust the position of the bevel in relation to the outer edge of the lens, and ensure that it follows the curvature of the individual lens while remaining at the right distance from the edge. The machine is a copier, and as such, utilizes a tracing mechanism for reproduction from the pattern lens; cam control is adopted for scaling the size of the copied lens up or down in relation to the pattern.

10 Claims, 5 Drawing Sheets

AUTOMATIC MACHINE FOR SHAPING THE EXTERNAL PROFILE OF SPECTACLE LENSES

BACKGROUND OF THE INVENTION

The invention relates to an automatic machine for shaping the external profile of lenses fitted to spectacles.

There are two types of shatterproof organic material in current use for spectacle lenses, namely CR 39, and polycarbonate, which differ substantially in terms of hardness; polycarbonate lens material is markedly tougher to work than CR 39, and hitherto, has required the use of grinding rather than cutting equipment.

Shatterproof lenses are supplied in circular format with a diameter significantly greater than the ultimate dimensional requirements, in order to permit of being cut down to the size of any given model of spectacle frames.

Lenses of the type have to be given a bevel, which can be either positive (in relief) or negative (sunken), in order to enable their fitment to the spectacle frames. Conventional frames require three different types of bevel, two of which in relief, the other sunken, which must be located at a given distance from the outer edge of the lens, according to the type of frames and the thickness of the lens itself.

Machines currently adopted for shaping the external profile of spectacle lenses are provided with a rotatable shaft carrying a cutter or grinding wheel, according to whether CR 39 or polycarbonate material is to be worked. The lens is held between coaxial pivots and rotated, the pivots themselves being mounted to a hinged support that can be drawn nearer to or distanced from the cutter or grinding wheel by hand, following the outline dictated by the pattern lens.

Conventional machines are beset by a number of drawbacks over and above the simple fact of being manually operated.

A first drawback is that the cutter (or the grinding wheel) must be changed each time different bevel requirements are encountered; also, the lens carriage is fed manually into the cut, the result being that cutting pressure is not steady and even, but subject entirely to the skill of the operator.

In conventional machines, there is no way that the position of the bevel, in relation to the outer edge of the lens, can be adjusted according to the thickness of the lens; neither is there any automatic method of altering the position of the lens during cutting so as to adapt to its curvature and thus ensure correct location of the bevel at all points round the lens in relation to the outer edge. Where these two operations are omitted, as is the case when using conventional machines, difficulties will arise when the lenses are fitted to the frames; more exactly, the bevel fails to correspond to the curvature of the lens with sufficient precision, and the frames thus have to be significantly distorted in order to accommodate the lenses.

The main object of the invention disclosed is that of overcoming the drawbacks mentioned above, providing a machine that will supply the cutter to match the required bevel, automatically.

A further object of the invention is that of enabling adjustment of the position of the bevel in relation to the outer edge of the lens, maintaining the position constant at all points around the lens, notwithstanding variations in curvature.

An additional object of the invention is that of enabling adjustment of the rate at which the lens carriage is fed into the cut, and control of the speed at which the various cuts are implemented, according to the hardness of the material from which the lens is fashioned.

SUMMARY OF THE INVENTION

The stated objects are achieved, together with others, by adoption of the automatic machine disclosed.

An automatic machine for shaping spectacle lenses according to the invention comprises three cutters operated simultaneously by drive means turning at constant speed, and a lens carriage that is traversed through an axis parallel to that about which the cutters rotate, mounted so as to pivot about an axis located to the rear of and parallel with the cutter axis, and provided with means by which to rotate the pattern lens and the copy lens about their own axes at one and the same time.

The machine disclosed comprises a variety of automatic devices, namely: a cutter selection device which traverses the lens carriage into a position whereby the lens is offered to the requisite cutter; a positioning device which adjusts carriage traverse for the purpose of selecting the distance separating the bevel from the outer edge of the lens; a cam which modifies carriage traverse in such a way as to ensure that the bevel follows the curvature of the lens and remains at the prescribed distance from its outer edge; means by which to produce rotation of the carriage about the axis to which it is pivotably mounted; a cam control for scaling the lens diameter up or down in relation to that of the pattern; and a programmer serving for selection of the requisite number of single shaping cuts and the rate of feed, according to the material from which the lenses are fashioned.

BRIEF DESCRIPTION OF THE DRAWINGS

The invention will now be described in detail by way of example, with the aid of the accompanying drawings, in which.

DESCRIPTION of the PREFERRED EMBODIMENT

Figure 1:
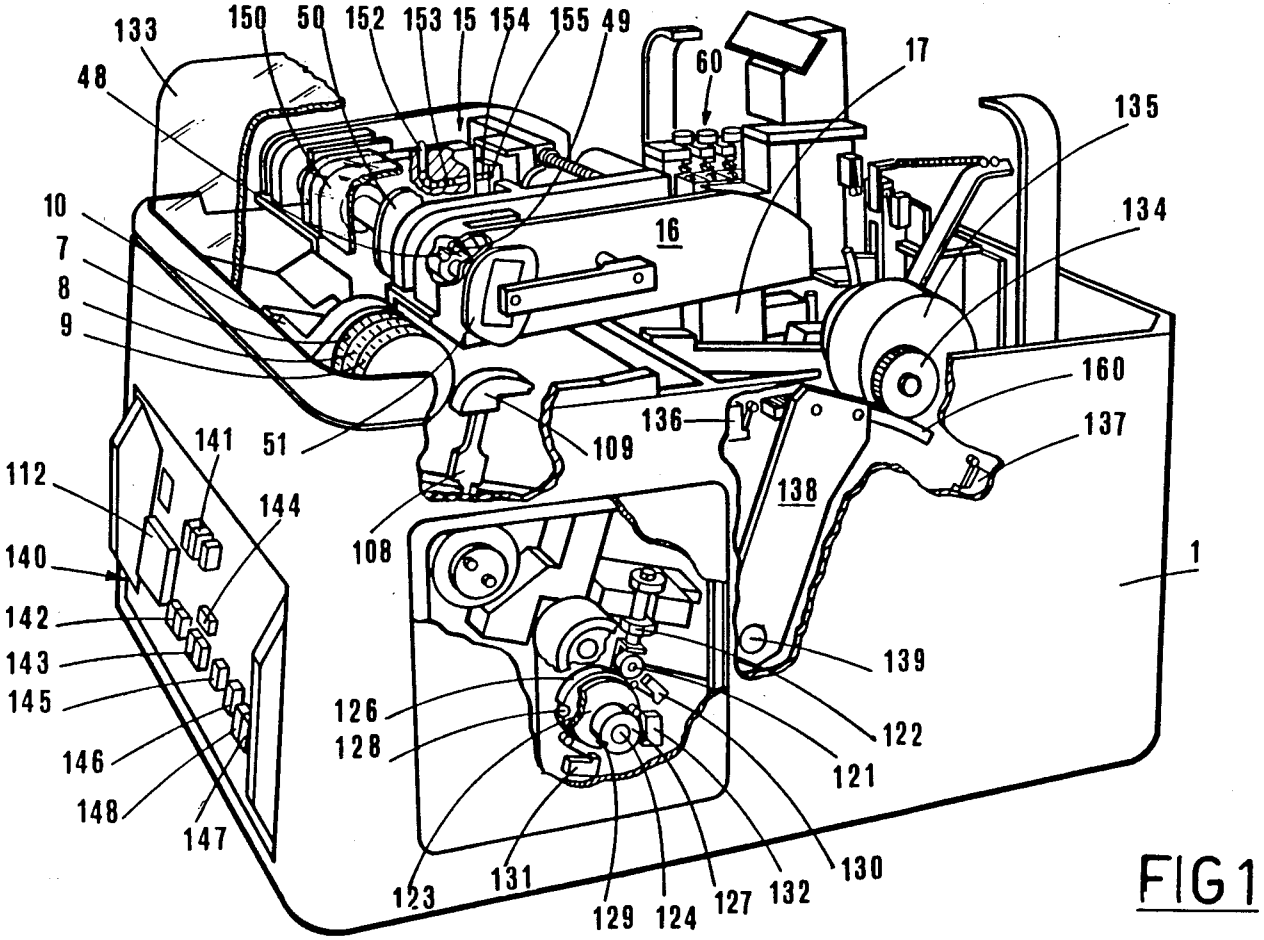
FIG. 1 is a perspective of the machine as a whole, in which certain parts are cut away better to reveal others.
Figure 2:
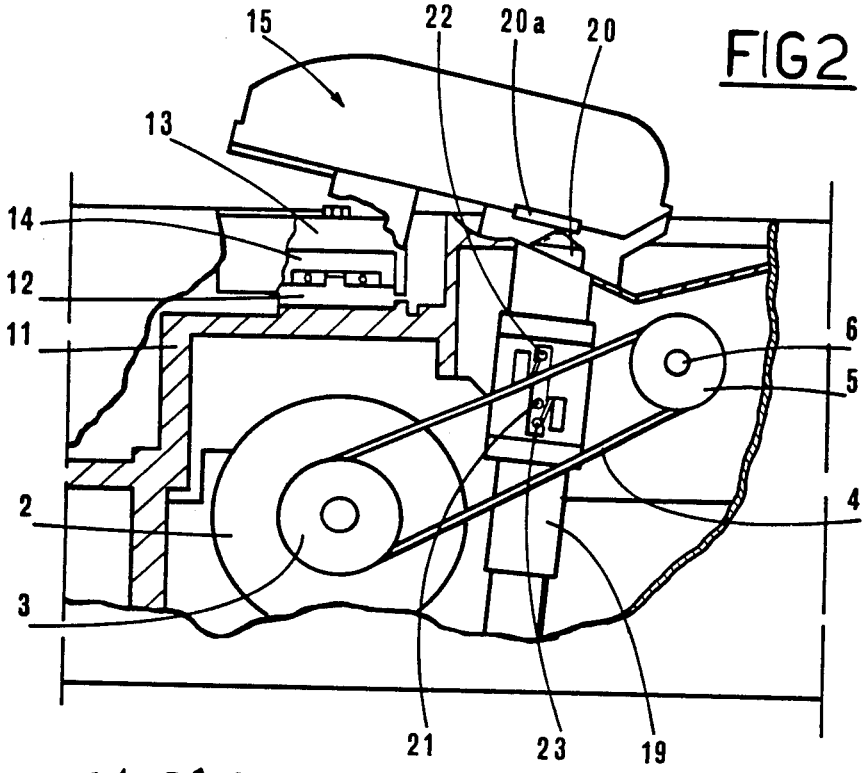
FIG. 2 is a side elevation of the machine, viewing from the opposite side to the perspective of FIG. 1, in which certain parts are cut away better to reveal others.

With reference to FIGS. 1 & 2 of the drawings, 1 denotes the main frame of the machine, which is substantially parallelepiped in shape and houses an electric motor 2 with a pulley 3 keyed to its rotor spindle; this pulley drives a belt 4 looped around a further pulley 5 that is keyed to a shaft 6 carrying three cutters, denoted 7, 8 and 9. The three cutters are of respective type such as to produce the three bevels currently utilized for spectacle frames.

The cutter shaft 6 is journalled to a bearing block 10 rigidly attached to the machine 1.

11 denotes a plate attached rigidly to the inside of the frame 1, which affords support to a roller way 12 the top part of which, denoted 13, connects by way of a plate 14 with a lens carriage denoted 15 in its entirety. The carriage 15 consists of a frame 16 embodied with two brackets 17 that are pivotably mounted to a common shaft 18 supported by the plate denoted 14. Thus, the frame 16 of the lens carriage 16 is able to rotate about the shaft 18, as well as being able to slide back and forth along the roller way 12, transversely to the cutters.

The pivoting motion of the lens carriage 15 is controlled by an electro-mechanical device such as a two-speed electric motor 19 and worm drive integral with a contact bolt 20 that impinges on a plate 20*a* integral with the carriage. The contact bdlt 20 is provided with a limiter 21 designed to engage two microswitches 22 and 23 that establish the overall travel permitted to the carriage when pivoting.

Figure 3:
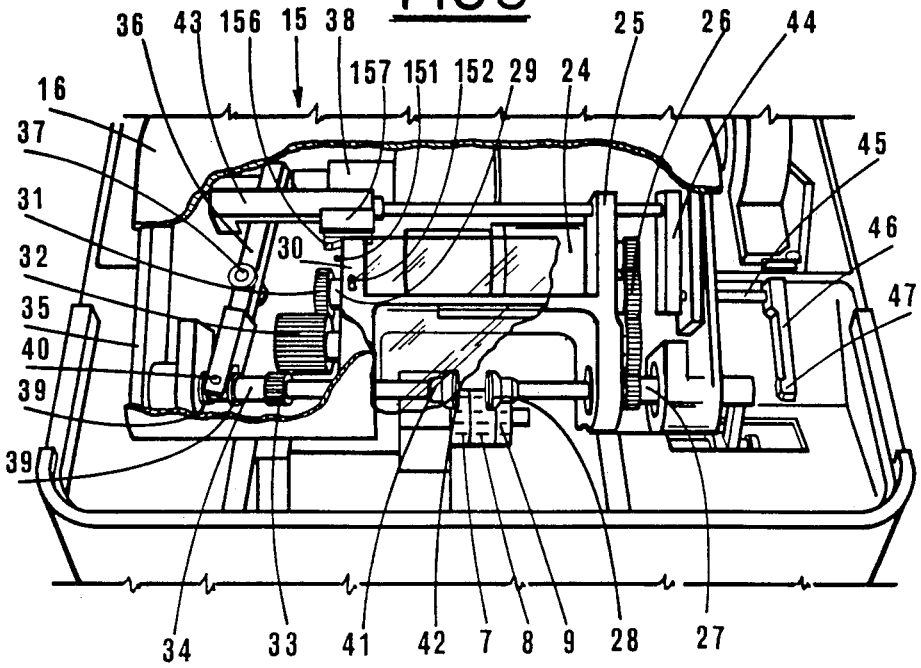
FIG. 3 is a perspective of the lens carriage and its drive system, viewed from the front.

With reference to FIGS. 2 & 3 of the drawings, 24 denotes an electric motor located internally of the carriage frame 16, mounted to a plate 25 that also supports a train of gears 26 by which rotation is transmitted from the motor 24 to a shaft 27 which exhibits a terminal cup 28 at the one end, its other end projecting from the frame 16 for reasons that will become apparent in due course.

One gear of the train 26 is keyed to a shaft 29 that runs across between the mounting plate 25 and a further parallel plate 30, and projects at the far end, where it carries a gear 31 meshing with an idle wheel 32 which, in its turn, meshes with a pinion 33 keyed to a further shaft 34 lying coaxial with the shaft denoted 27. The shaft 34 in question is located between the plate denoted 30 and a plate denoted 35, and shifts axially when impinged upon by a lever 36 pivoted about a fulcrum denoted 37 and provided with clevis ends, one such end connected to an actuator 38 (e.g. a pneumatic cylinder) the other located between two stop rings 39 offered by the shaft 34, and anchored thus by way of a pin 40.

The shaft denoted 34 exhibits a terminal cup 41 similar to that of the shaft 27 first mentioned; 41 denotes a layer of antifriction material with which each cup is faced.

Embodied thus, the shaft 34 is rotatable about its own axis, and can slide axially in such a way that its terminal cup 41 is offered to the cup 8 of the other shaft 27, thereby clamping a lens 50 to be shaped (see FIG. 2), from either side.

43 denotes a rod that is pivotably attached to the end of the lever 36 to which the actuator 38 is hinged; the rod 43 is slotted through the support plate 25 and connects with an arm 44, this connected in turn with a further rod 45 that projects from the frame 16 of the lens carriage.

46 denotes an arm attached rigidly to the end of the projecting rod 45, which exhibits a terminal stretch 47 lying coaxial with the adjacent shaft 27. This terminal stretch 47 serves to align and lock a pattern lens 51 in position against the end of the shaft 27 which projects from the carriage frame 16. The projecting end of the shaft 27 exhibits a groove 48 designed to interact with a microswitch 49, the operation of which will become clear in due course.

Th components described thus far constitute means by which a lens 50 to be shaped, and a lens 51 serving as the pattern, can both be held fast and rotated simultaneously about a common axis.

Figure 4:
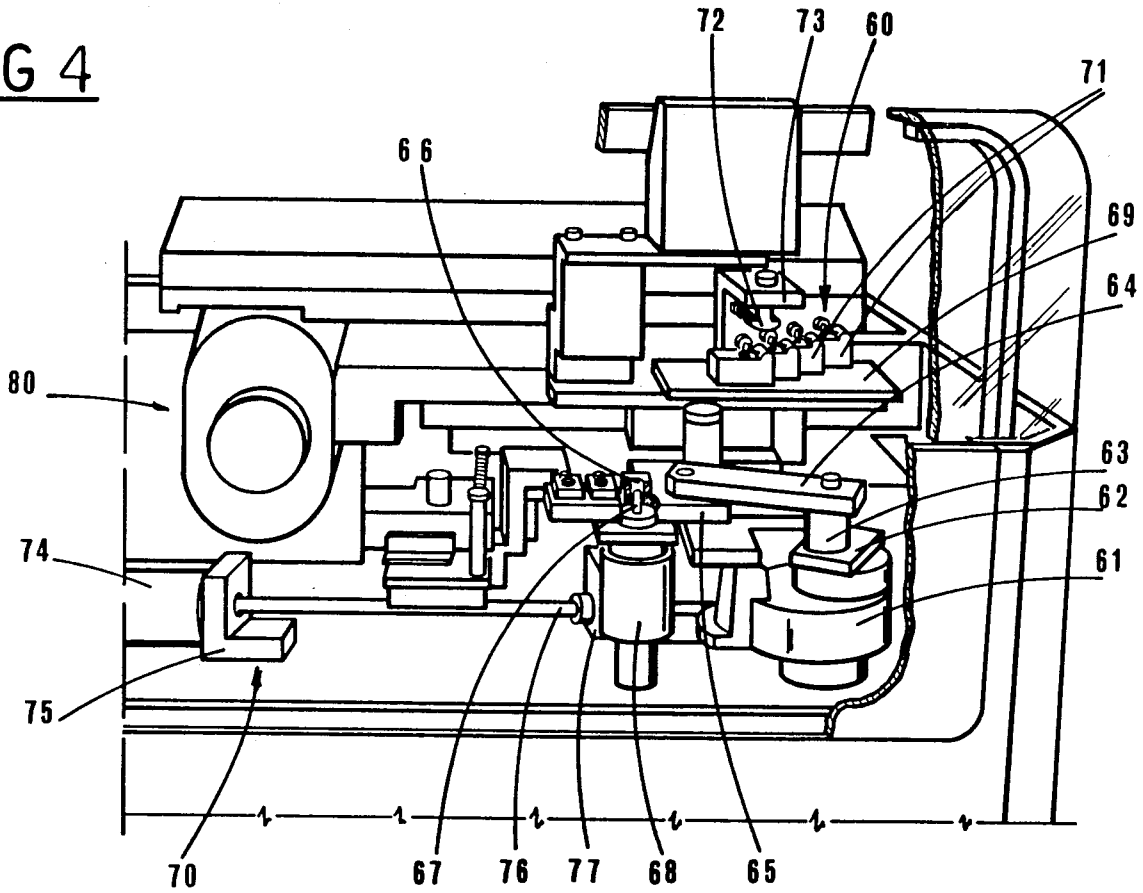
FIG. 4 is a perspective of the machine, viewed from the rear.

With reference to FIGS. 1 & 4 of the drawings, 60 denotes a selection device located behind the lens carrige 15 in the rear section of the machine, which serves to position the lens opposite whichever of the cutters 7, 8 or 9 is to be used; 70 denotes a positioning device for adjustment of the distance separating the bevel from the outer edge of the lens; 80 denotes a cam mechanism which ensures that the bevel follows the curvature of the lens 50 and remains at the distance established by way of the positioning device 70.

The cutter selection device 60 (see FIG. 4) comprises an electric motor 61 the spindle of which rotates an arm 62 that hinges by way of a pivot 63 with a rod 64, this hinged in turn with a plate 65; 66 denotes one of three holes in the plate 65, which are designed to accommodate a pin 67 actuated by an electromagnet 68.

69 denotes a further plate rigidly associated with that denoted 65, to which four microswitches 71 are mounted. Three of the four switches 71 interact with three limiters 72 mounted to a plate rigidly associated with the stationary frame of the machine. The three switches are staggered, each set apart from the next at a distance identical to that which separates the three holes 66 from one another.

The positioning device 70 for adjustment of the distance separating the bevel from the outer edge of the lens comprises an electric motor 74 mounted to a plate 75 rigidly attached to the main frame. The spindle of this motor 74 connects by way of a conventional universal joint (not illustrated) with a lead screw 76 which mates with a relative lead nut 77; the plate 65 of the cutter selection device is attached to this nut, hence shifted by rotation of the screw 76, and is connected bodily to the lens carriage, so that movement of the plate in relation to the three cutters signifies movement of the entire carriage, hence the lens 50, in relation thereto.

Figure 7:
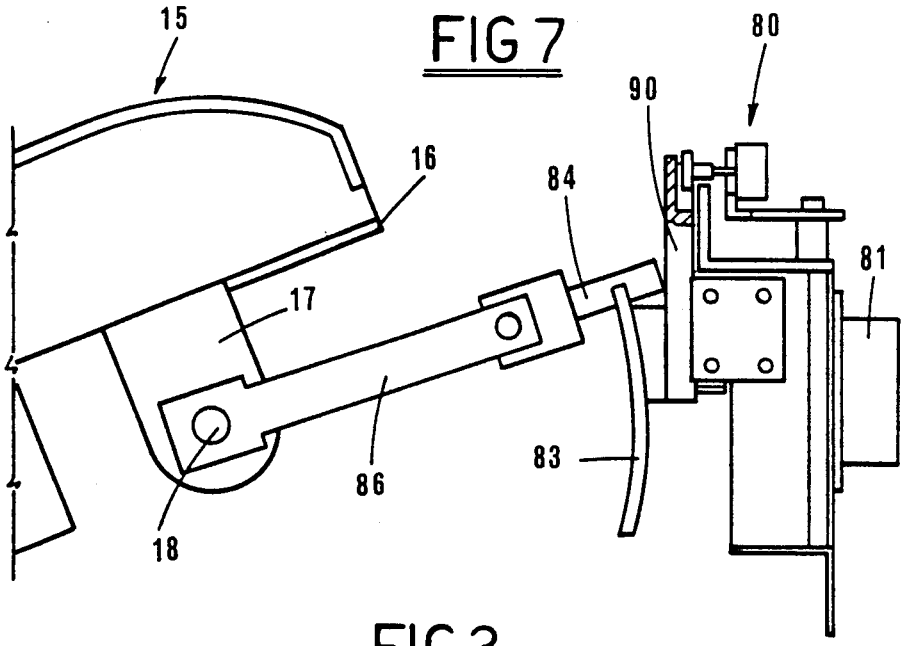
FIG. 7 is a side elevation of the mechanism shown in FIG. 5.
Figure 5:
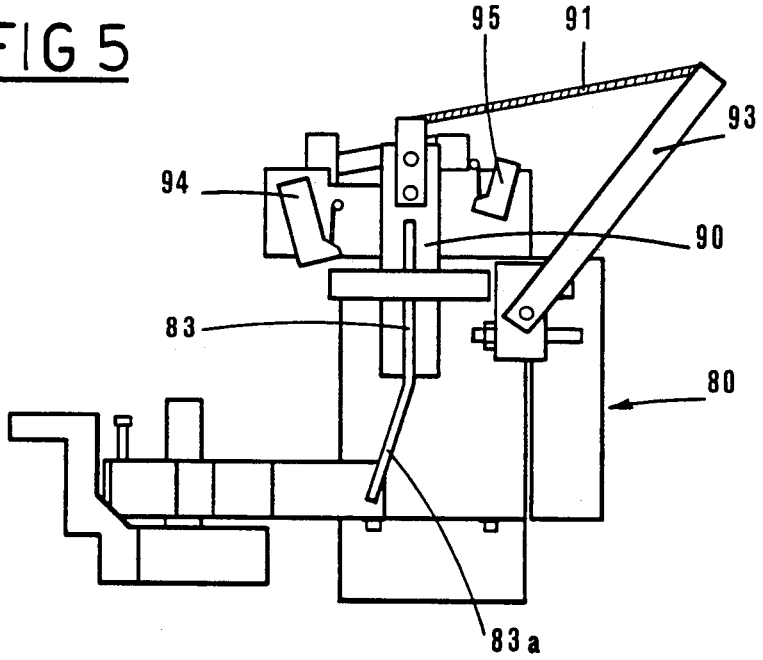
FIG. 5 is a front view of the cam mechanism which ensures that the bevel follows the the curvature of the lens and remains at the prescribed distance from its outer edge.
Figure 6:
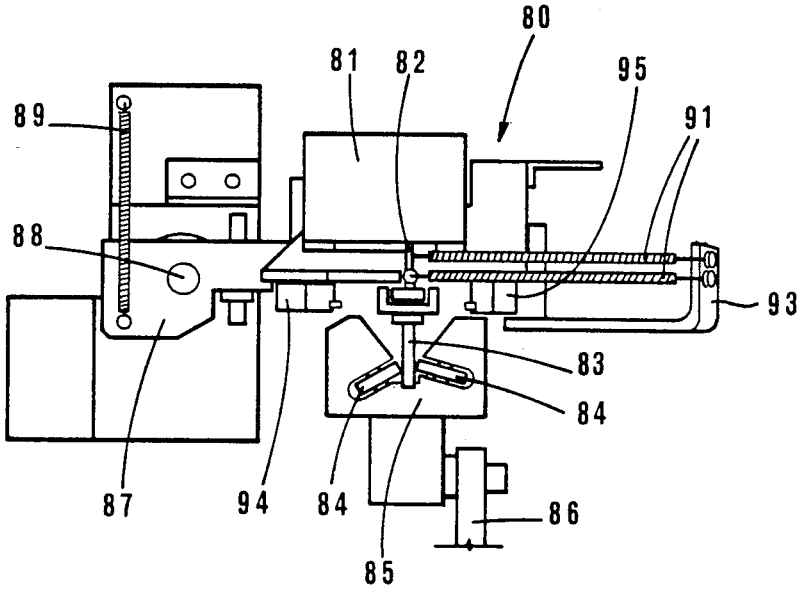
FIG. 6 is the plan of the mechanism shown in FIG. 5.

The cam mechanism 80 (see FIGS. 5, 6 and 7) comprises an electric motor 81 the spindle 82 of which carries a plate 90 that affords support to a cam 83. The cam consists substantially in a curved cylindrical bar, its curvature centered on the axis of the lens carriage pivot shaft 18, located between two followers 84 carried by a yoke 85 integral with a lever 86 the end of which is rigidly attached to one of the carriage brackets 17 and rotatable about the pivot shaft 18. The plate 87 carrying the motor 81 is keyed to a pivot 88, such that the entire subassembly of motor 81 and cam 83 is rotatable about this same pivot.

The cam 83 is urged against the wheels 84 by the action of a spring 89, and has one end 83*a* bent in the direction of the cutter selection device 60 in order to permit of maneuvering the lens carriage on termination of the shaping cycle.

90 denotes a plate that connects by way of tensioning springs 91 with a fixed anchor 93, thus preventing unwarranted movement of the motor 81, and 94 and 95 denote two microswitches rigidly attached to the motor plate 87, which establish the travel limits of the hinged plate 90, hence of the cam 83 associated therewith.

Figure 8:
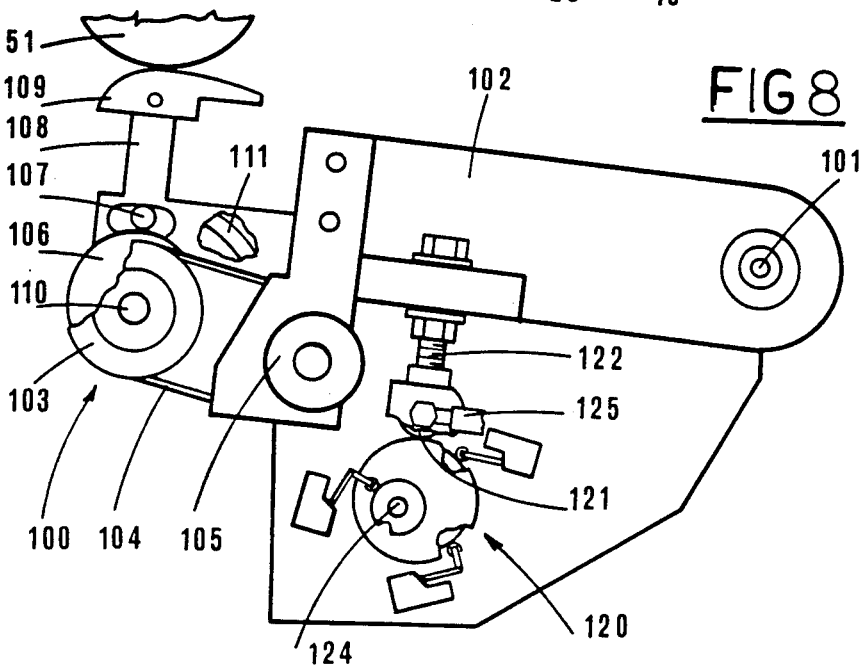
FIG. 8 is a side elevation of the cam control serving to scale the diameter of the copy lens up or down in relation to that of the pattern lens, and of the programmer serving for selection of the number of cutting steps and the rate of feed, on the basis of the type of lens material, in which certain parts are cut away better to reveal others.

With reference to FIGS. 1 & 8 of the drawings, 100 denotes cam control means for enlargement or reduction of the diameter of the lens 50 in relation to that of the pattern 51. Such means comprise a pivot 101 integral with the machine frame, to which an arm 102 is hinged. The arm in question carries a timing pulley 103 interconnected by way of a timing belt 104 with an adjuster knob 105; the pulley 103 is rigidly attached to a cam 106 that makes contact with a pin 107 rigidly attached to a rod 108 the top end of which carries a tracer 109 positioned such as to enter into contact with the pattern lens 51.

The pivot 110 extending from the arm 102, to which the timing pulley 103 is mounted, also carries a potentiometer 111 by way of which the difference in diameter between the lens 50 and the template 51 can be visualized on a display 112 at the front of the machine.

120 denotes a programmer by which the number of steps in the shaping operation are selected on the basis of the type of lens material. The facility comprises a follower 121 mounted to the arm 102 of the cam control means by way of a set screw 122, and positioned such that rotation of the arm 102 about its pivot 101 will bring it down into contact with a cam 123 keyed to a power driven spindle 124.

The follower 121 is wired into the circuit of the motor by which the spindle 124 is driven, and thus serves as a switch contact triggering cut-in and cut-out of the motor circuit; 125 denotes the relative terminal.

126 and 127 denote two wheels likewise keyed to the spindle 124, which exhibit respective slots 128 and 129 designed to interact with a set of three microswitches, two of which, denoted 130 and 131, are positioned such as to engage the slot 128 of the one wheel 126, and the third 132 positioned so as to engage the slot 129 of the other wheel 127.

133 denotes a transparent cover (see FIG. 1) that encloses the entire lens carriage and cutter area during shaping operations. The cover is rigidly attached to an arm 138 that is anchored to a pivot 139 and carries a contoured rack 160 the teeth of which mesh with a pinion 134 keyed to the spindle of an electric motor 135.

136 and 137 denote two microswitches by means of which travel of the arm 138, hence of the cover 133, is suitably limited. The switch denoted 136 also serves as a safety cutout by interrupting power supply to the control components of the machine as long as the cover remains open.

Operation of the automatic machine will now be described, with reference to the front control panel 140 which, in addition to the display 112 aforementioned, comprises a set of three buttons 141 giving selection of the type of bevel to be cut into the edge of the lens. 142 denotes a button giving selection of the position of the bevel in relation to the outer edge of the lens; a button 143 located immediately alongside provides for selection of the lens curvature, enabling the operator to ensure that the bevel follows its path and remains equidistant from the outer edge at all points around the lens. An indicator 144 located above this button 143 gives visual confirmation of the position of the bevel as determined by the curvature of the lens.

145 denotes the programming button. A machine according to the invention will perform three types of cut: 1st-roughing, 2nd-roughing, and finishing. All three steps will be required for polycarbonate lenses, which are singularly tough, whereas the second and third only will suffice for lenses in the softer CR 39 material. Accordingly, the button 145 in question permits of selecting the number of steps to suit the type of material from which the lenses are fashioned, namely, first-rough, second-rough and finish for polycarbonate, and rough and finish only for CR 39.

A further button 146 on the panel serves for selection of the rate at which the lens is fed down into the cut, likewise according to the hardness of the lens material.

147 denotes a button that serves to operate the pneumatic cylinder when clamping the lens 50 and pattern 51 in position prior to commencement of the cut, and 148 denotes the button which starts and stops the machine.

Before cutting is commenced, the operator selects the number of steps to be implemented, as dictated by the type of lens material, the type of bevel to be incorporated, and the rate of feed.

Having depressed whichever one of the set of three buttons 141 corresponds to the type of cutter required to produce the bevel, the machine responds by starting up the lens carriage traverse motor 61, whereupon the rod 64 slides the carriage across to the point where the microswitch 71 selected by the button 141 engages the relative limiter 72. At this juncture, the pin 67 is driven by the electromagnet 68 up into the respective hole 66 in order to make certain that no shift of the carriage occurs during the cutting operation as a result of vibration.

The rate of feed, that is, the speed at which the carriage descends into the cut, is selected by depressing the button denoted 146; it is this button that operates the two speed motor denoted 19.

The number of steps to be implemented, which will be dictated by the hardness of the material in which the lens is fashioned, must also be selected by depressing the programming button 145, the effect of which is to produce the requisite configuration at microswitches 131 and 132; more precisely, the switch denotes 132 triggers the start of the second roughing cut, whilst the switch denoted 131 triggers the start of the finishing cut. The switch denoted 130 brings the full cycle to a close.

An additional operation to be performed by hand prior to setting the machine in motion is that of selecting the diameter of the lens 50 to be cut, in relation to that of the pattern lens 51. This is achieved by turning the adjuster knob 105, thereby rotating the cam 106 and raising or lowering the rod 108 carrying the tracer 109 which makes contact with the pattern lens.

Depressing the button denoted 143 will set the relative motor 81 running, thereby rotating the plate denoted 90, hence the cam 83, through a given angle that can be read off on the indicator 144. The position of the cam 83 will be selected to suit the curvature of the lens 50. More exactly, the cam will be disposed upright for a plain lens, so that the carriage is subject to no compensating movement in the course of the cut; the greater the rake of the cam 83, on the other hand, the farther the carriage will be shifted by the followers 84.

With the machine appropriately set up, the lens 50 to be cut is positioned between the cups 28 and 41 of the carriage shafts 27 and 34, and the pattern lens 51 fitted between the terminal stretch 47 of the arm denoted 46 and the projecting end of the adjacent shaft 27. The two lenses are clamped in position by depressing button 147, which operates the pneumatic cylinder 38.

At this point, the cover can be lowered into position and the start button 147 depressed; this sets the cutter motor 2 in motion, and starts up the feed motor 19 at whichever speed has been selected. Descent of the lens carriage brings the pattern 51 into contact with the tracer 109, and thereafter, the entire carriage will pivot about its shaft 18 following the path dictated by the pattern lens 51. At the same time as the pattern lens is brought into contact with the tracer 109, the arm denoted 102 rotates about its pivot 101 such that the relative follower 121 is brought down into contact with the cam 123, whereupon spindle 124, cam 123 and wheels 127 and 126 will all begin turning; these components interact with the three microswitches that trigger the start of the second and the third cutting steps and the end of the full shaping cycle, respectively.

With the first and/or second roughing step completed, the operator selects the position of the bevel in relation to the outer edge of the lens, shifting the carriage across by using the relative button 142 to start up the motor 74 that turns the lead screw 76.

A machine according to the invention will be provided with an extractor system for the purpose of removing the chips that drop to the bottom; such a system is not illustrated, being well within the scope of a person having ordinary skill in the art.

A second, smaller transparent cover 150 is incorporated into the machine to prevent chips from flying up at the main transparent cover when the cutters are turning; this cover encases the part of the carriage immediately above the lens 50, and is hinged about a pivot 151 to the frame of the lens carriage.

152 denotes a plunger (see FIG. 1) slidably accommodated by a bore in the lens carriage frame, beneath which a set of balls 153 occupies both this bore and a further bore set at right angles thereto, which accommodates a further plunger 154 with a camprofiled end 155. The plunger 154 and cam 155 are urged into contact with the angled surface 156 of a plate 157 integral with the actuator rod 43. Thus, the transparent carriage cover 150 is raised and lowered automatically with the release and clamp strokes of the actuator.

In the machine thus embodied, use would be made throughout of d.c. motors in order to permit of accurate speed setting and control.

What is claimed:

1. Automatic machine for shaping the external profile of spectacle lenses, comprising:

at least three cutters operated simultaneously by drive means turning at constant speed;

a lens carriage that is traversed through an axis parallel to that about which the cutters rotate, mounted so as to pivot about an axis located to the rear of and parallel with the cutter axis, and provided with means by which a pattern lens and the lens to be shaped may be rotated about their own axes at one and the same time;

a cutter selection device which traverses the lens carriage into a position whereby the lens is offered to the requisite cutter;

a positioning device which adjusts lens carriage traverse for the purpose of selecting the distance that separates the bevel from the outer edge of the lens;

a cam mechanism which modifies carriage traverse in such a way as to ensure that the bevel follows the the curvature of the lens and remains located at the prescribed distance from its outer edge;

means by which to produce rotation of the carriage about the axis to which it is pivotably mounted;

a cam control for scaling the diameter of the cut lens up or down in relation to that of the pattern;

a programmer designed to implement the requisite number of cutting steps and rate of feed suitable for the type of material from which the lenses are fashioned.

2. Automatic machine as in claim 1, wherein the drive means operating the cutters comprise a motor connected to the cutter shaft by way of a timing belt.

3. Automatic machine as in claim 1, wherein the lens carriage comprises two brackets pivotably mounted to a shaft that is disposed parallel to the cutter shaft and supported by the top part of a roller way rigidly attached to the main frame of the machine.

4. Automatic machine as in claim 1, wherein the means by which a pattern lens and a lens to be cut can be rotated about their axes at one at the same time comprise:

an electric motor transmitting drive to a first shaft, one end of which exhibits a terminal cup, the other end projecting from the lens carriage, and to a second shaft disposed coaxial with the first, capable of shift in the direction of its own axis, and provided with a terminal cup at the end adjacent to the terminal cup of the first shaft;

an actuator producing movement of the second shaft on the one hand, in such a way that the lens to be shaped is clamped between the terminal cups of the two shafts, and of a lever on the other, in such a way that the pattern lens is clamped between the projecting end of the first shaft and the terminal stretch of an arm attached to the lever and disposed coaxial with the projecting end of the shaft.

5. Automatic machine as in claim 1, wherein the cutter selection device comprises:

an electric motor connected by way of a rod to the roller way;

at least three microswitches arranged in staggered formation and moving as one with the lens carriage in such a way as to engage corresponding limiters rigidly attached to the machine frame;

at least three manually operated selector buttons wired into the respective microswitch circuits, which serve to halt the traversing lens carriage at the required position.

6. Automatic machine as in claim 1, wherein the device by means of which the position of the bevel is determined in relation to the outer edge of the lens comprises an electric motor the spindle of which is connected to a lead screw engaging with a lead nut anchored to the carriage roller way.

7. Automatic machine as in claim 1, wherein the cam mechanism comprises an electric motor the spindle of which associates with a cam consisting substantially in a curved cylindrical bar separated from the lens carriage pivot shaft by a distance equal to its radius of curvature, and two followers urged into contact with the cam by spring tension, which are carried by a yoke integral with a lever pivotably mounted to the lens carriage pivot shaft and rigidly associated with the carriage itself.

8. Automatic machine as in claim 1, wherein the lens carriage is pivoted by means comprising a two-speed electric motor connected to the carriage by a mechanical transmission link.

9. Automatic machine as in claim 1, wherein the cam control means for scaling the diameter of the cut lens up or down in relation to the pattern lens comprise a manually operated adjuster knob connected to a cam engaging a pin integral with a rod the top end of which carries a tracer located in such a way as to enter into contact with the pattern lens.

10. Automatic machine as in claim 1, wherein the programmer, by means of which the requisite number of shaping cuts is implemented according to the type of lens material, comprises:

a power driven spindle with which a cam, and two wheels provided with respective slots, turn as one;

a follower designed to enter into contact with the cam only when the pattern enters into contact with the tracer of the cam-controlled diameter adjustment means, and serving to trigger a switch contact;

three microswitches, two of which are positioned so as to engage the slot of the one wheel and serve to trigger the start of the finishing cut and the end of the shaping cycle overall, the third positioned so as to engage the slot of the remaining wheel, and serving to trigger the start of a second roughing cut.

* * * * *